US006773287B2

(12) United States Patent
Takashita

(10) Patent No.: US 6,773,287 B2
(45) Date of Patent: Aug. 10, 2004

(54) ELECTRICAL CONNECTOR FOR FLAT CONDUCTOR

(75) Inventor: Yoshinori Takashita, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/704,874

(22) Filed: Nov. 12, 2003

(65) Prior Publication Data

US 2004/0097118 A1 May 20, 2004

(30) Foreign Application Priority Data

Nov. 14, 2002 (JP) ..... 2002-330997

(51) Int. Cl.[7] ..... H01R 13/62
(52) U.S. Cl. ..... 439/260; 439/495; 439/329
(58) Field of Search ..... 439/260, 495, 439/329, 327

(56) References Cited

U.S. PATENT DOCUMENTS 5,203,714 A * 4/1993 Tuan ..... 439/326
5,676,562 A * 10/1997 Fukuda ..... 439/329
5,993,247 A * 11/1999 Kidd ..... 439/495
6,210,195 B1 * 4/2001 Ma ..... 439/327
6,224,418 B1 * 5/2001 Miura et al. ..... 439/495
6,283,779 B1 * 9/2001 Lung ..... 439/260
6,338,648 B1 * 1/2002 Miura et al. ..... 439/495
6,352,442 B1 * 3/2002 Kudo ..... 439/260
6,370,036 B1 * 4/2002 Boe ..... 361/801
6,379,176 B1 * 4/2002 Ohsawa et al. ..... 439/495
6,431,907 B1 * 8/2002 Ma ..... 439/495
6,517,367 B2 * 2/2003 Yamane ..... 439/260
6,602,083 B2 * 8/2003 Tsunematsu ..... 439/260

FOREIGN PATENT DOCUMENTS

JP 6-86289 12/1994
JP 8-180940 7/1996

* cited by examiner

*Primary Examiner*—Gary Paumen
(74) *Attorney, Agent, or Firm*—Kanesaka & Takeuchi

(57) ABSTRACT

An electrical connector (1) for a flat conductor (40) having engagement steps (42) comprises terminals (32) arranged in a housing (10) and having contact portions (33A), and a pair of engagement members (13) having engaging means (13A), which engage the engagement steps of the flat conductor in concert with the contact portions to firmly hold the flat conductor in the housing.

6 Claims, 4 Drawing Sheets

ELECTRICAL CONNECTOR FOR FLAT CONDUCTOR

BACKGROUND OF THE INVENTION

1. Field of the Invention

This invention relates to an electrical connector for connecting a flat-type conductor.

2. Description of the Related Art

The electrical connection between a flat-type conductor, such as a flat cable and a flexible board, and a terminal is generally performed by inserting part of the flat conductor carrying a contact section and also a movable member of the terminal into an electrical connector so that the contact section of the terminal is brought into resilient contact with the contact section of the conductor. In this case, the electrical connector is provided with a means for tentatively holding the flat conductor in the connector before inserting the movable member.

For example, as shown in FIG. 4, Japanese Patent Application Kokai Number 6-86289 discloses a connector having a plate-shaped terminal with a pair of arms extending in parallel to each other; an upper one is a holding arm and a lower one is a contact arm. When a flexible board is inserted between the two arms, a contact section of the flexible board is brought into contact with a contact projection of the contact arm and the two arms hold the flexible board to keep the contact between the contact section and contact projection.

Japanese Patent Application Kokai Number 8-180940 discloses that a locking claw integrally made with a housing engages, from the upper side of a flexible board (a printed circuit board), a cut-off portion provided at both edges of the flexible board to tentatively holding the flexible board. In addition, a movable member is inserted into the connector to prevent the warp of the locking claw thus preventing the drop off of the flexible board.

However, in Japanese Patent Application Number 6-86289, since the flexible board is held by the friction resistance, close work is required to increase the friction resistance upon insertion of the flexible board for firm hold. Also, it is difficult to confirm that the flexible board has been inserted up to the position for firm contact with the terminal. The friction resistance produced by the contact with the contact and holding arms is constant during the insertion of the flexible board and does not increase discontinuously at a specific position during the insertion. Accordingly, it is difficult to judge if the insertion has been stopped halfway.

In Japanese Patent Application Number 8-180940, it is easier to confirm that the flexible board has been inserted up to a predetermined position because the locking claw engages the cut-off portion of the flexible boars, which gives the feeling of click. However, the direction of the engagement between the locking claw and the cut-off portion and the direction of the contact between the flexible board and the contact projection are the same so that the depth of the engagement becomes small because of the warp of the flexible board by the contact pressure from the contact projection, which causes the problem that the locking claw is prone to come off. Also, when the flexible board is inserted into the housing with the guidance by guidance sides of the housing, if the width of the flexible board is larger than the distance of the guidance sides even only by little, the flexible board is warped by the guidance sides in the widthwise direction thereof, which causes insufficient engagement between the flexible board and locking claw.

BRIEF SUMMARY OF THE INVENTION

Accordingly, it is an object of this invention to provide an electrical connector for connecting a flat conductor, wherein it is possible to confirm that the flat conductor has been inserted up to a predetermined position and firmly prevent the flat conductor from dropping off before the insertion of a movable member.

According to an aspect of the invention, an electrical connector for a flat conductor having a plurality of connection portions arranged on a face thereof in a widthwise direction thereof and at least one engagement step, comprises a housing, a plurality of terminals arranged in and supported by the housing and having contact portions, a movable member supported by the housing and pressing the flat conductor against the contact portions so that the contact portions are brought into resilient contact with the corresponding connection portions of the flat conductor when the movable member is moved to a closed position, and at least one engagement member provided on an opposite side of the contact portions with respect to the flat conductor and having engaging means for engaging the engagement step of the flat conductor in an insertion direction of the flat conductor in concert with the contact portions.

According to an aspect of the invention, since the flat conductor is held between the contact portions of the terminals and the engagement members, it is held firmly in the housing. Since the engagement between the engagement steps of the flat conductor and the engaging means of the engagement member provides the feeling of click, it can be confirmed by the user that the flat conductor has been inserted into the housing up to a predetermined position. In addition, the flat conductor is pressed by the contact portions to such a direction as the engagement is strengthen so that the flat conductor does not come off easily. The engagement between the engagement steps and the engaging means acts as tentative holding of the flat conductor before the movable member is rotated to the closed position. As a result, it is prevented that the flat conductor moves from a predetermined position before or during the movement of the flat conductor to the closed position.

When the movable member is rotated to the closed position during the tentative holding, although the depth of the engagement between the engaging means of the engagement member and the engagement steps of the flat conductor is decreased a little, the flat conductor is strongly held between the movable member and the contact portions of the terminals so that the large holding strength can be obtained. The tentative holding is sufficient if the flat conductor does not move from a predetermined position during the movement of the movable member to the closed position.

According to another aspect of the invention, the engagement member is flexible and the engaging means of the engagement members are provided outside a range of the contact portions of the terminals in a direction of arrangement of the terminals. Accordingly, the engagement members engage the engagement steps provided at sides of the flat conductor. Since the sides of the flat conductor is outside the range of the contact portions of the terminals, the size of the connector is minimized in the widthwise direction thereof.

It is preferable that positions of the engaging means and the contact portions are offset in an insertion direction of the flat conductor. With this structure, the amount of the displacement of the contact portions becomes large.

The engagement members may be made integrally with the housing. Alternatively, the engagement member may be made of a metal and supported by the housing, and includes a fixed portion exposed outside the housing for fixing the engagement member to a circuit board. The flexible engagement member may have engaging means at such a position as the engaging means are displaced.

DESCRIPTION OF THE PREFERRED EMBODIMENT

Figure 1A:
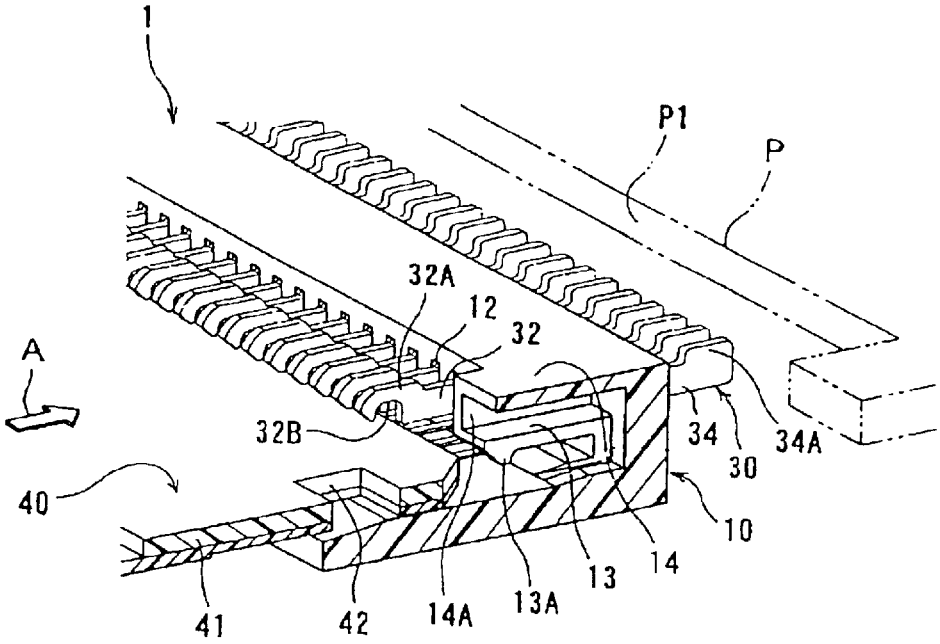
FIG. 1(A) is a sectional perspective view of part of an electrical connector with a movable member removed according to an embodiment of the present invention, as seen when a flat conductor is being inserted.
Figure 2A:
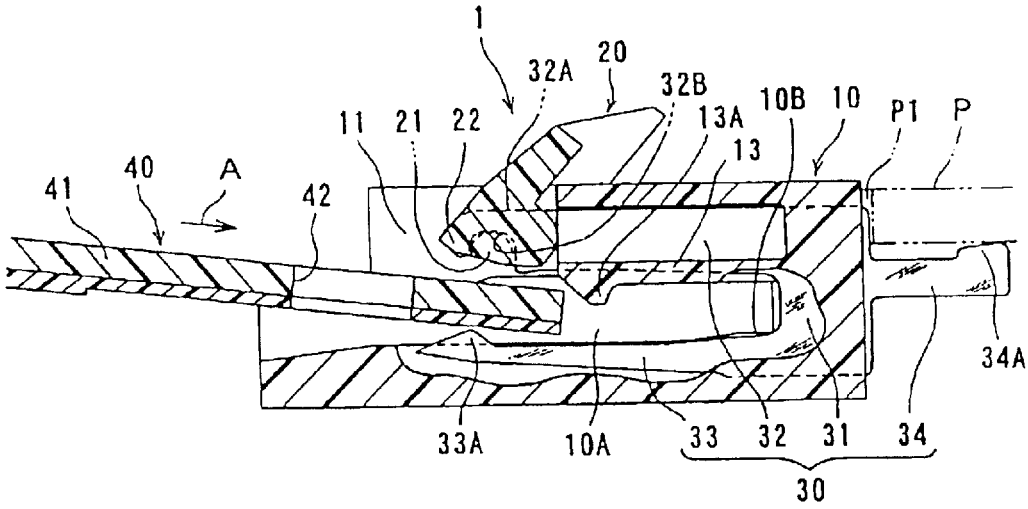
FIG. 2(A) is a sectional view of engagement members of the connector of FIG. 1, as seen when the flat connector is being inserted.

In FIGS. 1(A) and 2(A), a flat conductor 40 is inserted into an electrical connector 1 fixed to a circuit board P in a direction shown by arrow A.

The connector 1 comprises a connector body 10 made of an electrically insulating material, a movable member 20, and a plurality of terminals 30 made of a conductive material. Each of the terminals 30 is made by punching a metal sheet with its flat face maintained. The terminal 30 has a base 31, an upper support arm 32 extending forwardly (left in the drawings) from the base 31, a lower flexible arm 33 extending forwardly from the base 31, and a connection arm 34 extending rearwardly from the base 31. The terminals 30 are arranged in parallel to each other at a predetermined interval in widthwise direction thereof (a direction in parallel to a plane of the flat conductor 40 and perpendicular to the arrow A).

The housing body 10 has a shape of substantially rectangular parallelepiped having a longitudinal side in the widthwise direction of the terminals. The body 10 has an opening 11 in the left and a cavity 10A formed in parallel with the bottom face thereof so that the top portion of the flat conductor 40 is inserted into the cavity 10A through the opening 11. The housing body 10 is provided with a plurality of slits 12 having a width corresponding to the thickness of the terminals at a predetermined interval so that the terminals are inserted into and held in the slits 12.

A front portion 32A of the support arm 32 of the terminal 30 projects forwardly from the housing body 10 and a substantially semi-circular concave fulcrum 32B is provided in the lower edge of the front portion 32A. The flexible arm 33 extends in substantially parallel to the support arm 32 up to a position forward of the fulcrum 32A. A contact portion 33A is provided at the top of each flexible arm 33 and projects upwardly from the slit 12. The contact portion 33A is displaced by the flexibility of the flexible arm 33 so that it moves in an out the slit 12. The connection arm 34 extends rearwardly from the base 31 up to the outside the housing body 10 and has a connection portion 34A. When the connector 1 is accommodated in a cut-off of a circuit board P, the connection portion 34A is brought into contact with and connected to by an appropriate method, such as soldering, a corresponding trace (not shown) formed on the lower surface of the circuit board.

Figure 2B:
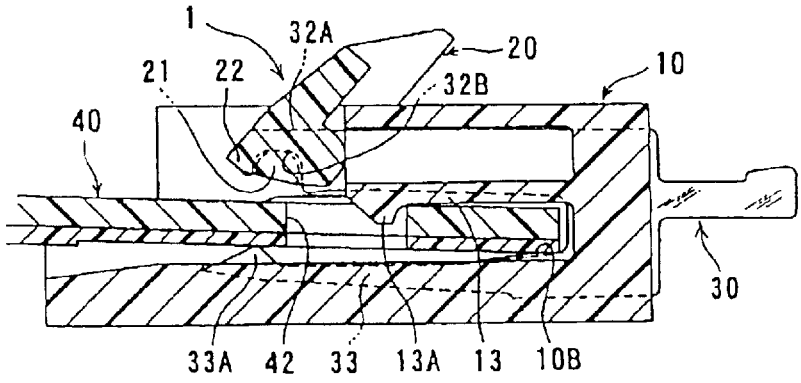
FIG. 2(B) is the same kind of view as FIG. 2(A), but as seen when the flat connector has been inserted.

As shown in FIG. 2(A), the movable member 20 is rotatably supported by the concave fulcrums 32A of the support arms 32 of the terminals 30. The movable member 20 moves in the opening 11 of the housing body 10 between an open position and a closed position. Here, the rotation may include rotation or revolution accompanied by linear movement. In FIG. 2, the movable member 20 is provided with a plurality of island-shaped axes 21 provided in opening spaces corresponding to the fulcrums 32 and connected to each other in the widthwise direction of the terminal 30 so that the axes 21 is rotatably supported by the fulcrums 32B of the terminals. The movable member 20 may have, in addition to the axes, shafts or holes at both sides thereof in a direction of the axes 21 so as to be rotatably supported by the housing body 10. The movable member 20 comprises a pressure portion 22 to press the flat conductor 40 against the contact portion 33A of the terminal 30 to increase the contact pressure at the closed position.

The housing body 10 comprises a pair of engagement member 13 at both ends thereof outside the range of arranged terminals 30 or outside the range of slits 12 in the widthwise direction. The engagement members 13 are made integrally with the housing body 10 and provided with engaging claws 13A at front portions thereof, which are resiliently displaceable with respect to a base of the housing 10. As shown in FIG. 1(A), the engagement member 13 is a wall extending outwardly from a wall 14A extending downwardly from an upper wall 14 of the housing body 10 in the direction of arrow A, and the engaging claw 13A is provided at the frontmost and outermost position of the engagement member 13 and projects downwardly. Accordingly, when the engaging claw 13A is pressed upwardly by the flat conductor 40 as described later, the engaging claw 13A is flexed and displaced upwardly.

The flat conductor 40 comprises, on its lower surface, a plurality of printed connection portions (not shown) at positions corresponding to those of the terminals 30 in the widthwise direction. The flat conductor 40 also comprises a circuit pattern extending from the connection portions in the longitudinal direction (left direction in the drawing) of the flat conductor 40 and as shown in FIG. 1(A), a reinforcement member 41 adhered to an upper and front portion thereof. A pair of cut-off portions 42 are provided at front side edges so that when the flat conductor 40 is inserted into the connector up to a predetermined position, the engaging claws 13A of the housing body 10 fits into the cut-off portions 42 for engagement in a thicknesswise direction of the flat conductor 40, thus tentatively holding and preventing the flat conductor 40 from coming off in a direction reverse to the arrow A.

How to operate the connector 1 will be described.

(1) The connector 1 is fixed to the circuit board P. The housing 10 is accommodated in the cut-off portion P1 of the circuit board P such that the connection portions 34A of the terminals 30 are brought into contact with and then soldered to the corresponding circuit traces on the lower surface of the circuit board P. Thus, the connector 1 is held by the circuit board P. The connector 1 may have an additional fixed section for fixing the circuit board P to reduce the burden imposed on the connection section by soldering.

(2) Then, as shown in FIG. 2(A), the movable member 20 is moved (rotated in the clockwise direction) to the open position and the flat conductor 40 is inserted in the direction of arrow A between the movable member 20 and the contact portions 33A of the terminals 20 such that a face of the flat conductor 40 carrying connection portions faces downwardly. Since the engaging claws 13A and the contact portions 33A are offset in the back-and-forth direction, it is possible to insert the flat conductor 40 obliquely a little. When the movable member 20 is at the open position, the flat conductor 40 can be inserted more obliquely so that the frictions between the flat conductor 40 and the contact portions 33A and the engaging claws 13A. Even in this case, the flat conductor 40 is turned into parallel with the support and contact arms by its weight after the insertion and can be tentatively held sufficiently.

Figure 1B:
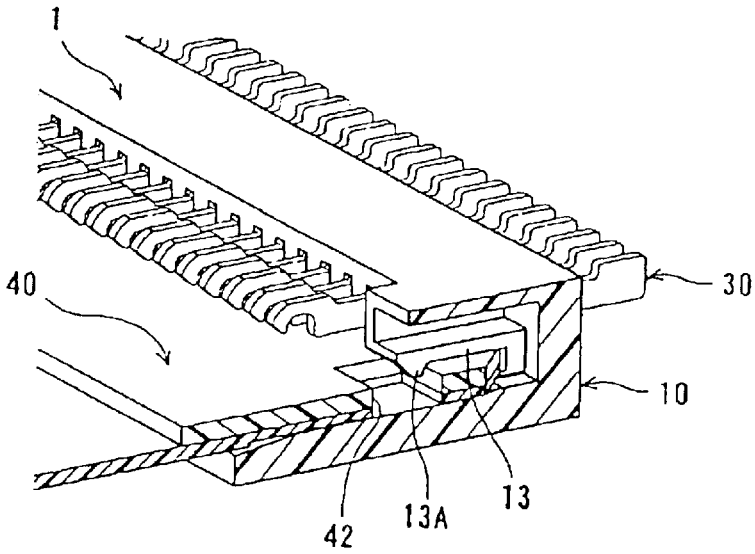
FIG. 1(B) is the same kind of view as FIG. 1(A), but as seen after the flat conductor has been inserted.

(3) As the flat conductor 40 is inserted, the top edge of the flat conductor 40 abuts against the engaging claws 13A of the engagement portion 13 and raises the engagement portion 13, which causes the upward flex of the engagement portion 13. Consequently, the engaging claws 13A are displaced upwardly and brought on the upper face of the flat conductor 40. When the flat conductor 40 is further inserted, the flat conductor 40 advances with its upper and lower surfaces slide-moving on the engaging claws 13A and the contact portions 33A, respectively, and the engaging claws 13A fit into the cut-off portion 42 of the flat conductor 40 for engagement (FIGS. 1(B), 2(B), and 3(A)). This means that the flat conductor 40 has been inserted up to a predetermined position, and the user can confirm it by the feeling of click. At this point, the flat conductor 40 receives upward contact pressure from the contact portions 33A so that the engaging claws 13A fit into the cut-off portion 42 deeply in the thicknesswise direction of the flat conductor 40, which prevents the flat conductor 40 from coming off in the removal direction thereof (left direction in FIG. 2(B)).

(4) Then, the movable member 20 is rotated to the closed position (rotated in the counter-clockwise direction) so that the pressure portion 22 of the movable member 20 strongly presses the flat conductor 40 against the contact portions 33A of the terminals 30. Consequently, the contact pressure between the flat conductor 40 and the contact portions 33A is increased so that the flat conductor 40 is firmly held and electrically connected.

Figure 3A:
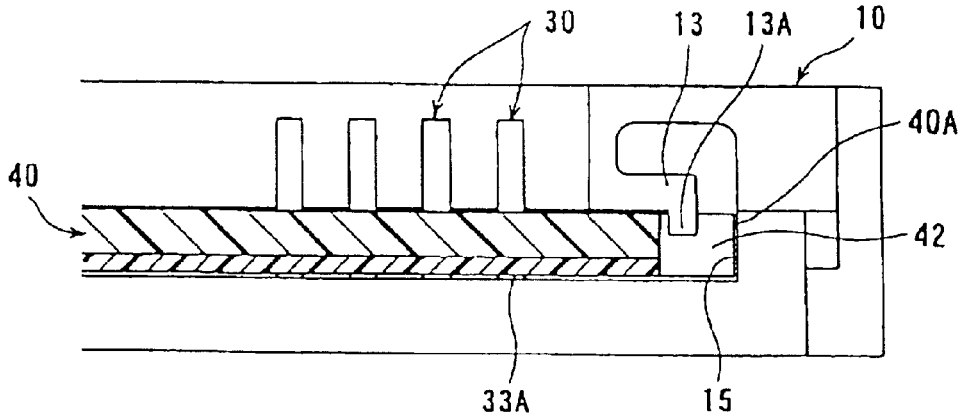
FIG. 3(A) is a front view of the connector of FIG. 1 with the flat conductor in section taken along with a line perpendicular to an insertion direction thereof, showing a case when the flat conductor has a width substantially equal to or a little smaller than that an internal width of guidance sides of a housing of the connector.
Figure 3B:
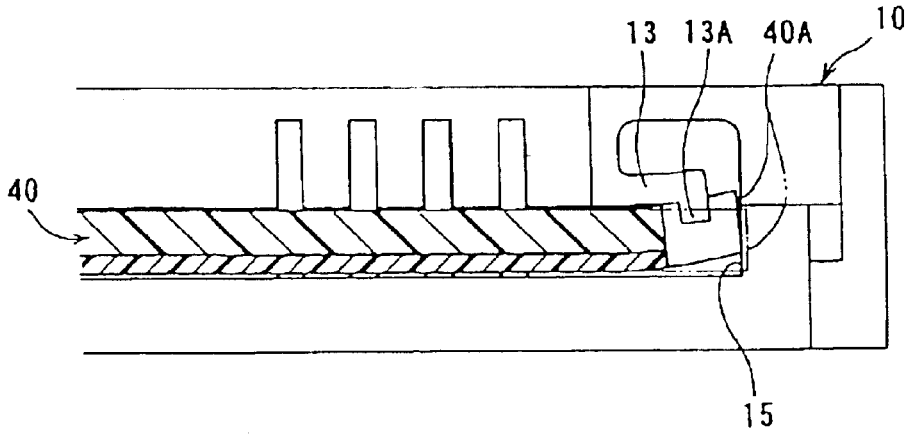
FIG. 3(B) is the same kind of view as FIG. 3(A), showing the case when the former is a little larger that latter.

(5) As shown in FIG. 3(A), the flat conductor 40 is inserted into the connector up to a predetermined position with side edges 40A thereof being guided by guidance sides 15 of the housing body 10. As shown in FIG. 3(B), when the width of the flat conductor 40 is larger than the distance between the guidance sides, the engagement member 13 is displaced upwardly into spaces provided at both sides of the flat conductor 40, which allows the flat conductor 40 to flex into the spaces. Even in this case, the engaging claws 13A fit into the cut-off portion 42 deeply, the engagement is firm.

If the engagement member is provided such that the engagement member has a base at inner sides of the housing in the widthwise direction of the housing and is flexed outwardly, the engagement means can be provided outside.

Figure 4:
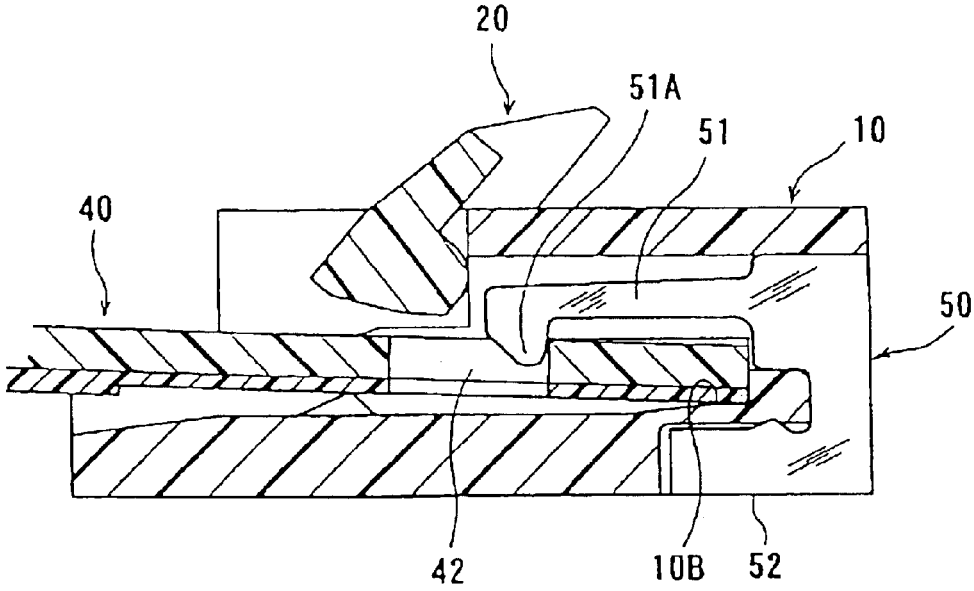
FIG. 4 is a sectional view of engagement members of an electrical connector according to another embodiment of the present invention.

The invention is not limited to the embodiments in FIGS. 1 to 3. For example, an engagement member 51 may be separate from the housing body 10 and made of, for example, a metal sheet and supported by the housing body 10. In FIG. 4, the engagement member 51 is an arm of a metallic part 50 made of a metal sheet and has an engaging claw 51A at the top thereof. If a fixed portion 52 or the lower edge of the metallic part 50 is exposed from the bottom of the housing body 10, when the connector is mounted on the circuit board, the fixed portion 52 is attached to corresponding part of the circuit board by soldering. Accordingly, the metallic part 50 can be used as a metal fixture too.

The flat conductor may have, as engaging means, a projection extending in the widthwise direction instead of the cut-off portion. In this case, the housing may have an engaging claw or an aperture, which engages the projection easily.

In the embodiments, the engagement member has flexibility. However, the engagement member may not have flexibility because the flat conductor can engage the engagement member by the displacement of the contact portion of the terminal.

In FIG. 2, a bulge 10B is provided on the inner bottom of the space 10A so that the top of the flat conductor is raised when it is inserted into the space 10A. Consequently, the flat conductor is supported by the contact portion and the bulge 10B and engages the engagement member in the middle thereof, thereby to secure firmer engagement.

As fully described, according to the invention, the flat conductor is pressed toward the engagement member by the contact pressure with the contact portion of the terminal so that the engagement step (cut-off portion) of the flat conductor engages the engagement member. Accordingly, the user can confirm the insertion of the flat conductor into the connector up to a predetermined position by the feeling of click. Also, it is possible to obtain sufficient amount of engagement force so that even if the flat conductor warps in the widthwise direction, the engagement is not readily released.

What is claimed is:

1. An electrical connector for a flat conductor having a plurality of connection portions arranged on a face thereof in a widthwise direction thereof and at least one engagement step, said electrical connector comprising:

a housing;

a plurality of terminals arranged in and supported by said housing and having contact portions;

a movable member pressing said flat conductor against said contact portions so that said contact portions are brought into resilient contact with said corresponding connection portions of said flat conductor when said movable member is moved to a closed position; and at least one engagement member provided on an opposite side of said contact portions with respect to said flat conductor and having engaging means for engaging said engagement step of said flat conductor in an insertion direction of said flat conductor in concert with said contact portions to prevent removal of the flat conductor.

2. The electrical connector according to claim 1, wherein said engagement members are flexible and said engaging means of said engagement members are provided outside a range of said contact portions of said terminals in a direction of arrangement of said terminals.

3. The electrical connector according to claim 1, wherein positions of said engaging means and said contact portions are offset in an insertion direction of said flat conductor.

4. The electrical connector according to claim 1, wherein said engagement members are made integrally with said housing.

5. The electrical connector according to claim 1, wherein said engagement member is made of a metal and supported by said housing, and includes a fixed portion exposed outside said housing for fixing said engagement member to a circuit board.

6. The electrical connector according to claim 2, wherein said flexible engagement member has said engaging means at such a position that said engaging means are displaced.

* * * * *